US006253963B1

(12) United States Patent
Tachibana

(10) Patent No.: US 6,253,963 B1
(45) Date of Patent: Jul. 3, 2001

(54) SYRUP DRINK SUPPLY NOZZLE ASSEMBLY

(75) Inventor: Manabu Tachibana, Mie (JP)

(73) Assignee: Fuji Electric Co., Ltd., Kawasaki (JP)

( * ) Notice: Subject to any disclaimer, the term of this patent is extended or adjusted under 35 U.S.C. 154(b) by 0 days.

(21) Appl. No.: 09/525,758

(22) Filed: Mar. 14, 2000

(30) Foreign Application Priority Data

Mar. 19, 1999 (JP) ..... 11-075607

(51) Int. Cl.[7] ..... B67D 5/56
(52) U.S. Cl. ..... 222/129.1; 239/423; 239/428
(58) Field of Search ..... 222/129.1; 239/423, 239/428

(56) References Cited

U.S. PATENT DOCUMENTS 5,649,644 * 7/1997 Hashimoto et al. ..... 222/129.1

FOREIGN PATENT DOCUMENTS 7-309398 11/1995 (JP) .
10-72099 3/1998 (JP) .
10-81398 3/1998 (JP) .

* cited by examiner

*Primary Examiner*—Philippe Derakshani
(74) *Attorney, Agent, or Firm*—Kanesaka & Takeuchi

(57) ABSTRACT

A syrup drink supply nozzle assembly for a drink dispenser is formed of a syrup nozzle head having a plurality of syrup introduction passages to introduce various syrups and syrup nozzles attached to the syrup introduction passages, a cylindrical syrup nozzle cover removably attached to a lower portion of the syrup nozzle head to surround the same, a diluent nozzle head removably attached onto the outer periphery of the syrup nozzle head and having a diluent passage for introducing cold diluent water or carbonated water, and a cylindrical spout nozzle removably surrounding the syrup nozzle cover and the diluent nozzle head and having a drink ejection port at a tip thereof. The syrup drink supply nozzle assembly has improved maintenance ability and nozzle functions.

17 Claims, 6 Drawing Sheets

2
28
cold water
19
19c
21c
24
21
21a
23
20
22
22a
syrup
carbonated water
cold water
19a
syrup
26
27
28
carbonated water
25
23a
21a-1
21a-2
21d
21b
19b
22b
syrup
19
19b

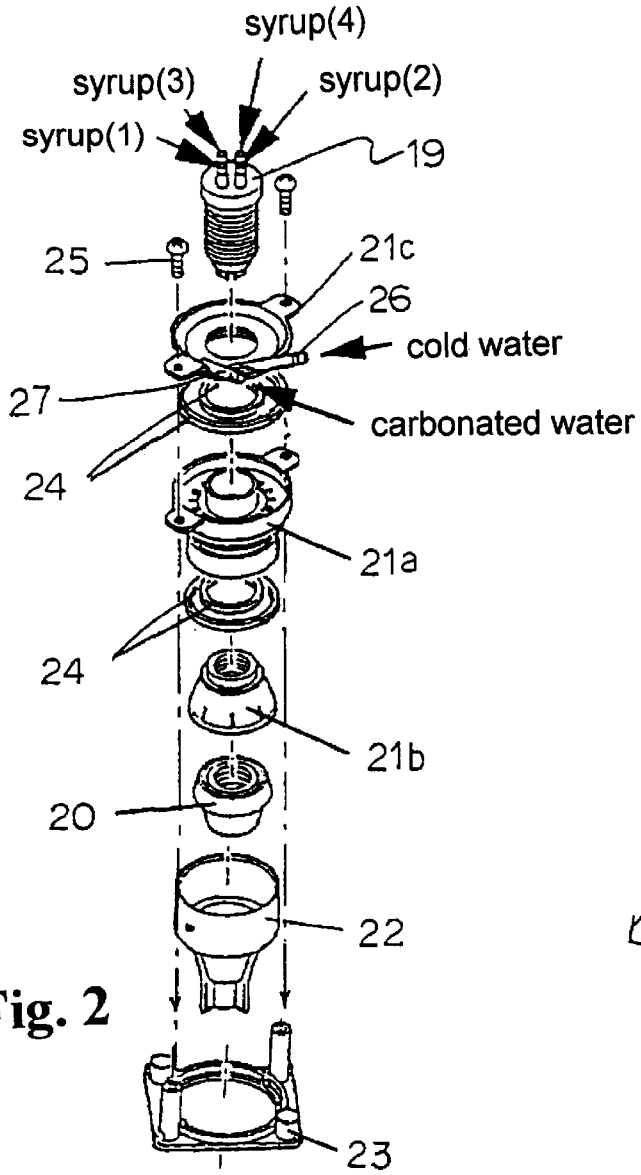
Fig. 2
Fig. 3
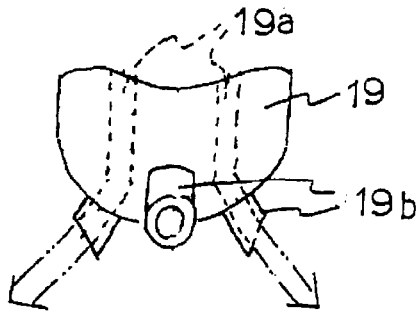
Fig.4(a)
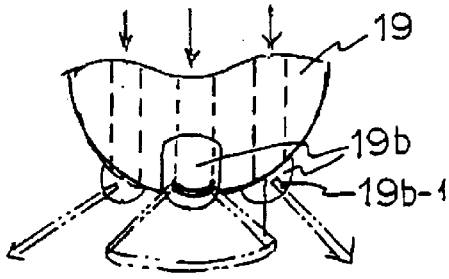
Fig. 4(b)
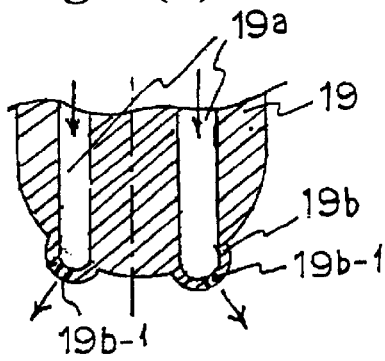

SYRUP DRINK SUPPLY NOZZLE ASSEMBLY

BACKGROUND OF THE INVENTION AND RELATED ART STATEMENT

The present invention relates to a syrup drink supply nozzle assembly installed in a drink dispenser or a cup drink vending machine for business use, to mix a syrup selected based on an instruction with cold water or carbonated water, and then to supply the mixture to a cup.

First, a drink dispenser such as that described above is taken as an example, with its drink system shown in FIG. 11. In this figure, numeral 1 is a drink dispenser, 2 is a drink supply nozzle provided in a vend stage 1*a* of the drink dispenser 1, 3 is a cooling-water bath built in the drink dispenser 1, 3*a* is an agitator for agitating the cooling water, 4 is a cooling unit for the cooling-water bath 3, 5 is a carbonator for producing carbonated water, 6 is a water supply pump connected to a water service pipe, 7A to 7D are syrup tanks for accommodating corresponding syrups of various flavors and colors, and 8 is a carbon-dioxide bomb.

Syrup lines 9, a carbonated-water line 10, and a cold-water line 11 are disposed between the drink supply nozzle 2 and each of the syrup tanks 7A to 7D, between the drink supply nozzle 2 and the carbonator 5, and between the drink supply nozzle 2 and the supply pump 6, respectively, via the cooling-water bath 3 of the drink dispenser 1. A cooling coil is interposed in each of the syrup lines 9A to 9D and cold water line 11 and immersed in water of the cooling-water bath 3, and the cold-water line 10 branches on its way to feed water to the carbonator 5 immersed in the cooling-water bath. Each line has corresponding syrup solenoid valves 12, carbonated-water solenoid valve 13, cold-water solenoid valve 14, and carbonator-water supply solenoid valve 15. In addition, pressurized carbon dioxide is supplied from the carbon-dioxide bomb 8 to each syrup tank 7A to 7D and the carbonator 5 through carbon-dioxide lines 16.

A drink dispenser of such a structure is well known. When an operator presses a drink selection button (not shown) with a cup 17 set on the vend stage 1*a* of the drink dispenser 1, a solenoid valve corresponding to the selected drink is opened according to an instruction from a control section in order to feed the drink supply nozzle 2 with the selected type of syrup and a diluent, that is, cold water (for a non-carbonated drink) or carbonated water (for a carbonated drink). The syrup and the diluent are mixed inside the nozzle and then ejected and supplied to the cup 17.

Next, FIG. 12 shows the construction proposed by the applicant in Japanese Patent Publication (KOKAI) No. 7-309398, as a conventional example of the drink supply nozzle 2 provided in the above drink dispenser. The syrup supply nozzle 2 is formed of an assembly of a nozzle head 2*a* and a cylindrical spout nozzle 2*c* installed on the outer periphery of the nozzle head 2*a* via an O-ring 2*b*. The nozzle head 2*a* has multiple syrup nozzles 2*d* formed therein so as to project downward from its tip and corresponding to the syrups, syrup introduction passages 2*d*-1 formed therein so as to lead to the corresponding syrup nozzles 2*d*, and a diluent passage 2*e*. The diluent passage 2*e* is formed of a combination of a vertical hole 2*e*-1 formed in the center of a top portion of the nozzle head 2*a* and horizontal holes 2*e*-2 radially branching from the terminal of a vertical hole 2*e*-1 and opened at a peripheral surface of the nozzle head. On the other hand, the spout nozzle 2*c* has a tip portion in the form of a circular arc, and has a drink ejection port 2*c*-1 formed in its center. In this drink supply nozzle 2, the syrup lines 9 corresponding to the various syrups as shown in FIG. 11 are connected to the inlets of the corresponding syrup introduction passages 2*d*-1 leading to the corresponding syrup nozzles 2*d*. In addition, the carbonated-water line 10 and the cold-water line 11 converge at the diluent passage 2*e*.

With such a construction, when a syrup drink is supplied, a syrup flowing from the syrup nozzle 2*d* and cold water or carbonated water ejected into the spout nozzle 2*c* through the diluent passage 2*e* are mixed together and then ejected from the drink ejection port 2*c*-l of the spout nozzle 2*c* toward the cup 17 (see FIG. 11) for supply.

In the conventional drink supply nozzle 2, the opening of the drink ejection port 2*c*-1 of the spout nozzle 2*c* is larger than the diameter of the circle enclosing all the syrup nozzles 2*d* so as to prevent the syrup dripping from the tip of the syrup nozzle 2*d* following the drink supply from adhering to an inner wall surface of the spout nozzle 2*c*, thereby preventing the syrup from mixing into the next drink sold. In addition, as shown in FIG. 13, the multiple syrup nozzles projecting from a lower end surface of the head 2*a* have their tips bent inward toward the center of the head 2*a* so that the locus of the syrup ejected from each syrup nozzle 2*d* generally passes the center of the drink ejection port 2*c*-1 formed in the tip of the spout nozzle 2*c* in order to prevent the syrup from adhering to the spout nozzle 2*c*, as is well known from Japanese Patent Publication (KOKAI) No. 10-72099.

Further, if carbonated water fed from the carbonator 5 following pressurization in the carbonated-gas bomb 8 as described in FIG. 12 is ejected, with its pressure maintained, into an inward space at the ambient atmospheric pressure in the spout nozzle 2*c* from the diluent passage 2*e* formed in the head 2*a* of the drink supply nozzle 2, the pressure then fluctuates rapidly to cause carbon dioxide dissolved in the carbonated water to substantially separate from water, thereby reducing the gas volume of the carbonated water to be mixed with the concentrated syrup. This degrades the quality of the carbonated drink. Thus, a pressure-reducing valve 18 is connected to a carbonated-water inlet extended from the drink supply nozzle 2 as shown in FIG. 12, so that the pressure of the carbonated water supplied from the carbonator through the carbon-dioxide line can be reduced to some degree before being introduced into the drink supply nozzle 2, as is well known from Japanese Patent Publication (KOKAI) No. 10-81398. The pressure-reducing valve 18 is structured so as to have a resistance piece 18*a* accommodated in a case 18*b*, and the resistance piece 18*a* has multiple pressure-reducing grooves formed on its outer peripheral surface, the grooves having an angular cross section.

The syrup drink supply nozzle assembly installed in a drink dispenser to selectively supply various syrup drinks of different flavors into a cup, as described above, is required to have the structures and functions specified below.

(a) Since the drink dispensers for business use in restaurants or the like must have their drink systems washed as a part of daily maintenance work for sanitation purposes, the drink supply nozzle has a structure that enables it to be simply disassembled and reassembled, and that can be washed easily by the user.

(b) In order to obtain high-quality drinks, a syrup and a diluent such as cold water or carbonated water supplied to the drink supply nozzle can be sufficiently mixed together inside the spout nozzle before the mixture is supplied to a cup, thereby allowing the diluent ejected into the spout nozzle to flow thoroughly and evenly over the entire periphery, without local mixture.

(c) In supplying a carbonated drink, the level of gas separation can be minimized while the carbonated water is passing through the drink supply nozzle, thereby maximizing the gas content in the carbonated water and enabling the supply of high-quality carbonated drink.

(d) During supply, drink is prevented from remaining in the spout nozzle due to the surface tension of the liquid, and thus flows out smoothly from the nozzle.

Analysis of the conventional drink supply nozzle 2 shown in FIG. 12 in view of the above points has revealed the following problems:

(1) When the multiple syrup nozzles 2*d* corresponding to various syrups, the syrup introduction passages 2*d*-1, and the diluent passage 2*e* are all formed in the unitary head 2*a,* the structure is complicated and manufacturing cost becomes high.

(2) Since the tip of the head 2*a* is flat and the syrup nozzles 2*d* are gathered to project therefrom toward the center of the head, syrup residue is likely to adhere to the flat tip surface of the head 2*a* and to remain thereon. In addition, this portion is difficult to clean due to the close arrangement of the syrup nozzles 2*d.*

(3) In addition, the diluent passage 2*e* formed in the head 2*a* by drilling is connected to a water service pipe via the cold-water line, so that a foreign material contained in city water may block the diluent passage inside the head. In such a case, it is also difficult to clean the inside of the diluent passage and to remove the foreign material from the passage. The pressure-reducing valve 18 connected to the carbonated water inlet of the drink supply nozzle 2 may similarly be blocked with a foreign material, and a large amount of time and labor is required to remove this foreign material due to the difficulty in disassembling the pressure-reducing valve.

(4) Despite the use of the pressure-reducing valve 18 connected to the inlet side of the drink supply nozzle 2 to reduce the pressure of supplied carbonated water, an amount of gas separated from the carbonated water increases due to repeated pressurization and pressure reduction during the flow through the subsequent diluent passage (bent into the form of an inverted "T") formed inside the nozzle. Consequently, high-quality carbonated drinks with a high gas content can not be obtained.

The results of various experiments on this point conducted by the inventor indicate that the optimal conditions for supplying high-quality carbonated water are those in which pressure reduction is carried out in the channel immediately before ejection into the spout nozzle, and in which rapid variation in pressure is not carried out within the diluent passage.

(5) When the diluent passage 2*e* formed in the head 2*a* is composed of holes that are dispersed in the peripheral surface of the head and are opened toward the spout nozzle 2*c,* the flow of the diluent is partially biased, thereby preventing the diluent from flowing uniformly over the entire inner peripheral surface of the spout nozzle 2*c.*

(6) The multiple syrup nozzles 2*d* are collectively arranged so as to face the center of the head in order to prevent syrup dripping from the nozzle from adhering to the spout nozzle 2*c,* so that syrup ejected from the syrup nozzle 2*d* and a diluent flowing down along the inner wall surface of the spout nozzle 2*c* may flow out from the drink ejection port 2*c*-1 toward the cup without being sufficiently mixed.

(7) When the cold-water line and the carbonated-water line converge on the diluent inlet of the head 2*a,* a pressure increase associated with drink remaining in the spout nozzle may cause carbonated water to flow backward into the cold-water line during the dispensing of a carbonated drink, whereas cold water may flow backward into the carbonated-water line during the dispensing of a non-carbonated drink. In particular, during the dispensing of a carbonated drink, the backward flow of carbonated water into the cold-water line may increase the loss of gas in the carbonated water.

(8) The remaining drink in the spout nozzle is the result of the surface tension of the liquid. In the conventional spout nozzle structure, however, the drink ejection port 2*c*-1 formed in the tip of the nozzle has a flat and continuous peripheral edge, whereby the surface tension of the liquid may contribute to occluding the drink ejection port 2*c*-1. Consequently, drink is likely to remain in the spout nozzle.

The present invention has been provided in view of the above points, and it is an object of the invention to solve each of the above problems in order to provide a syrup drink supply apparatus with improved maintenance ability in terms of parts washing or the like, as well as improved nozzle functions such as the mixing of a syrup and a diluent and maintenance of the gas content of carbonated water.

SUMMARY OF THE INVENTION

According to the present invention, to attain this object, a syrup drink supply nozzle assembly comprises a syrup nozzle head having multiple syrup introduction passages formed therein and individually corresponding to various syrups, and also having syrup nozzles formed therein; a removable cylindrical syrup nozzle cover installed so as to surround a peripheral area of a tip of the syrup nozzle head; a diluent nozzle head removably installed in the outer periphery of the syrup nozzle head so as to form a diluent passage corresponding to the cold water or carbonated water; and a removable cylindrical spout nozzle installed so as to surround the syrup nozzle cover and the diluent nozzle head and having a drink ejection port formed at its tip.

As described above, the present invention is constructed by forming the syrup nozzle head and the diluent nozzle head as two separate parts and combining these heads with the syrup nozzle cover and the spout nozzle to enable assembly and disassembly of these parts. This construction simplifies daily maintenance work, including parts cleaning, to improve service ability for users.

According to the present invention, in order to further improve nozzle functions and maintenance ability, each of the above parts may be constructed as described below.

(1) The syrup nozzle head has a spherical surface at its tip and multiple syrup nozzles dispersed on its peripheral surface area so as to project therefrom, and each syrup nozzle has its tip opened toward an inner wall surface of the spout nozzle.

(2) The syrup nozzle has a pipe-shape and an open end cut in an oblique direction toward the inner wall surface of the spout nozzle.

(3) The syrup nozzle has a pipe-shape and an open end inclined toward the inner wall surface of the spout nozzle.

(4) The syrup nozzle has a slit-shaped syrup ejection port opened in the horizontal direction toward the inner wall surface of the spout nozzle so as to disperse and eject a syrup in the form of a fan.

(5) The syrup nozzle has multiple syrup ejection holes dispersed and opened toward the inner wall surface of the spout nozzle so as to eject a shower of syrup.

(6) The removable syrup nozzle cover is threaded and so coupled to the syrup nozzle head to enable simple disassembly for maintenance.

(7) The diluent nozzle head comprises an upper head having a conical inner surface and a lower head having a conical outer surface. The upper and lower heads are fitted together in the vertical direction to form a conical diluent pressure-reducing passage between the fitting surfaces thereof. Thus, the heads can be disassembled to enable direct washing of the diluent pressure-reducing passage. The upper head has a gutter-shaped peripheral groove constituting a diluent introduction passage, and multiple diluent passage holes dispersed along the peripheral groove so as to connect the peripheral groove to the diluent pressure-reducing passage. Thus, the diluent can be evenly spread and supplied to the diluent pressure-reducing passage through the passage holes.

(8) In the structure as stated in (7), the lower head is threaded to allow installation on an outer peripheral surface of the syrup nozzle head and to allow the thread to adjust the passage gap in the diluent pressure-reducing passage formed between the fitting surfaces of the upper and lower heads installed on an outer periphery of the syrup nozzle head.

(9) In the structure as stated in (7), the diluent passage holes formed in the upper head are tapered so that their cross section gradually decreases from the inlet to the outlet. Thus, a diluent (carbonated water) can be evenly spread and supplied to the subsequent diluent pressure-reducing passage without a rapid change in pressure.

(10) In the structure as stated in (7), the lower head has rib-shaped projections formed on its outer peripheral surface so as to radially extend along its conical surface, and the rib-shaped projections are used as spacers to form the diluent pressure-reducing passage between the fitting surfaces of the upper and lower heads.

(11) In the structure as stated in (10), the rib-shaped projections are formed downstream of the diluent passage holes formed in the upper head so that the open ends of the outlets of the diluent passage holes are not occluded by the rib-shaped projections following assembly.

(12) In the structure as stated in (9), the gap in the diluent pressure-reducing passage formed in the conical fitting surface between the upper head and the lower head with the rib-shaped projections gradually decreases toward the outlet side of the passage, and the cross section of the passage along the diluent pressure-reducing passage is generally constant.

(13) The spout nozzle has a flat staged portion formed on its wall-surface site, against which a syrup is ejected from the syrup nozzle, thereby effectively mixing a diluent flowing down along the inner wall surface of the spout nozzle with the syrup.

(14) The spout nozzle may have a water-deflector projection or water-deflector notches in a peripheral edge of the drink ejection port formed in the tip of the spout nozzle. This construction prevents the surface tension of the liquid from acting on the peripheral edge, thereby preventing drink from remaining in the spout nozzle.

(15) Check valves are connected to a cold-water introduction port and a carbonated-water introduction port extended from the diluent nozzle head, thereby preventing, during drink supply, carbonated water from flowing backward into the cold-water line or cold water from flowing backward into the carbonated-water line.

BRIEF DESCRIPTION OF THE DRAWINGS

FIG. 2 is an exploded perspective view of the drink supply nozzle shown in FIG. 1(*a*);

FIG. 3 is a side view of a modified example of the syrup nozzle head in FIG. 1(*a*);

FIG. 4(*a*) is a side view for showing a tip portion of the syrup nozzle of an example different from that shown in FIG. 3, and FIG. 4(*b*) is a sectional view thereof;

DETAILED DESCRIPTION OF PREFERRED EMBODIMENTS

Embodiments of the present invention will be described based on the examples shown in FIGS. 1(*a*) to 10.

Figures 1A, 1B:
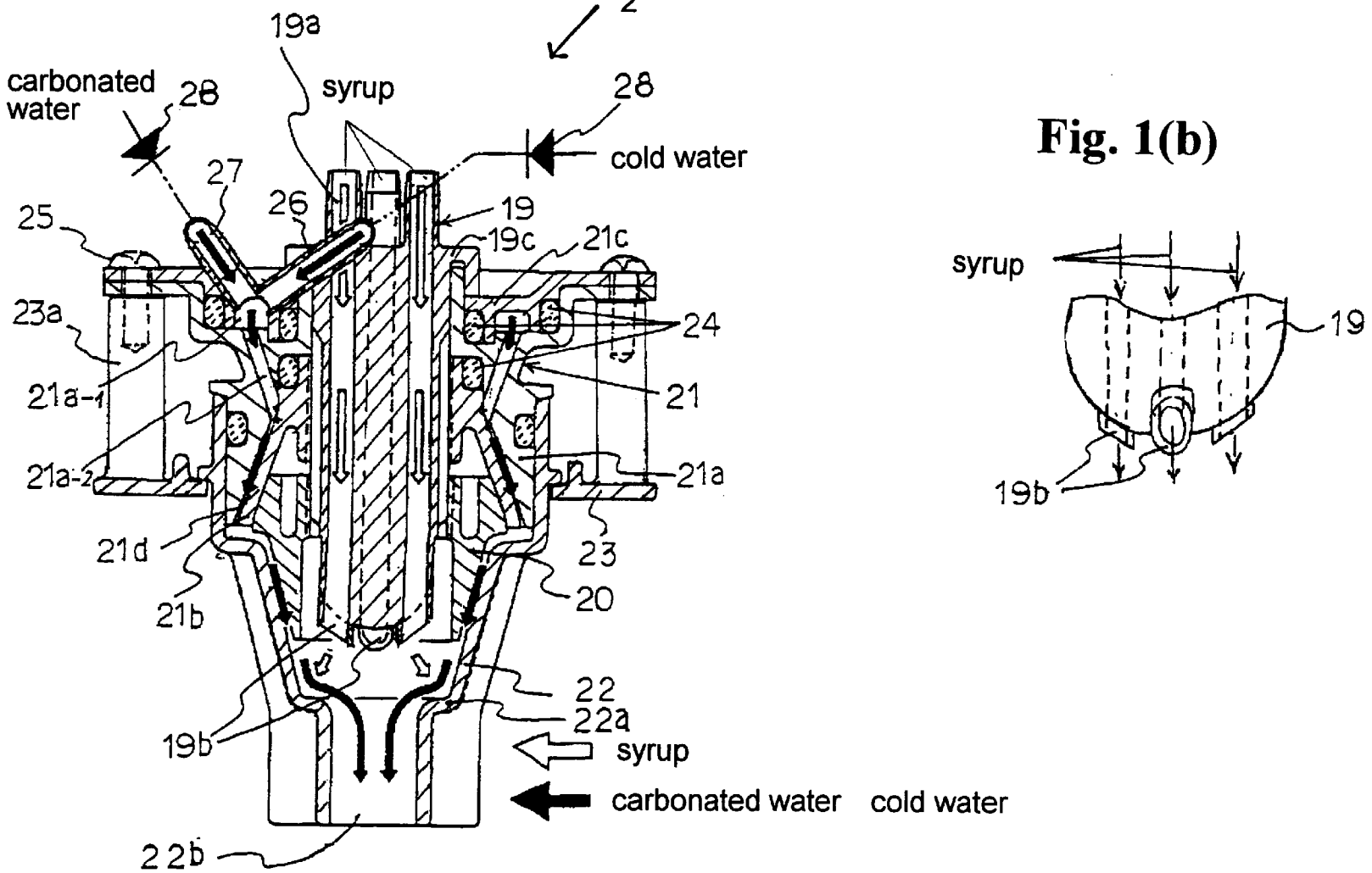
FIG. 1(*a*) is a vertical sectional view of a structure of an example of a syrup drink supply nozzle assembly according to the present invention, and FIG. 1(*b*) is a side view showing a tip portion of a syrup nozzle head.

First, FIGS. 1(*a*), 1(*b*) and 2 show a basic example of a syrup drink supply nozzle assembly. A drink supply nozzle 2 is roughly composed of an assembly of a syrup nozzle head 19, a syrup nozzle cover 20, a diluent nozzle head 21, a spout nozzle 22, and an assembly base 23, each of which is an independent part. Further, the diluent nozzle head 21 is divided and composed of an upper head 21*a*, a lower head 21*b*, and a head cover 21*c*, wherein the upper head is fitted on the lower head in the vertical direction, and a diluent pressure-reducing passage with a conical surface is formed in fitting surfaces between the upper and lower heads.

The syrup nozzle head 19 is formed of a cylindrical body with its lower tip formed into a spherical surface, multiple syrup introduction passages 19*a* individually corresponding to the various syrups described above, and pipe-shaped syrup nozzles 19*b* connected to the corresponding syrup introduction passages 19*a* and dispersed in a peripheral area of the spherical surface of the head tip so as to project therefrom. Each of the syrup nozzles 19*a* has an open end surface cut in an oblique direction so as to face an inner peripheral wall surface of the spout nozzle 22. The syrup nozzle head 19 has an external thread formed on its outer peripheral surface to allow another part to be coupled by threading onto the head.

In addition, the syrup nozzle cover 20 has a cylindrical shape that surrounds the syrup nozzles 19*b* and has an outer peripheral surface opposed to the inner peripheral wall surface of the spout nozzle via a gap forming a diluent passage. An internal thread is formed in an inner peripheral surface of a boss portion of the syrup nozzle cover 20, so that the cover 20 can be threaded onto the outer periphery of the syrup nozzle head 19.

On the other hand, the diluent nozzle head 21 is formed of a combination of the upper head 21*a*, the lower head 21*b*, and the head cover 21*c*. The upper head 21*a* has a deformed cylinder shape with a conical inner surface, and has a gutter-shaped peripheral groove 21*a*-1 that is formed in a top surface thereof to act as a diluent introduction passage, and multiple drilled diluent passage holes 21*a*-2 dispersed along the peripheral groove 21*a*-1 and extending obliquely downward toward the center of the head so as to connect the peripheral groove 21*a*-1 to the conical inner peripheral surface.

In addition, the lower head 21*b* has a deformed cylindrical shape with an umbrella-shaped structure, and has a conical outer peripheral surface to enable the lower head 21*b* to be fitted from below to the conical inner peripheral surface of the upper head 21*a*. The lower head 21*b* has an upper end coupled in a liquid-tight manner to the upper head 21*a* via O-rings 24. When the lower head 21*b* is fitted to the upper head 21*a*, a diluent pressure-reducing passage 21*d* is formed in fitting surfaces between these heads to function as a diffuser for a diluent (carbonated water or cold water). The lower head 21*b* has an internal thread formed on an inner peripheral surface of a boss portion of the lower head 21*b* to be threaded with the outer periphery of the syrup nozzle head 19. Thus, after the head cover 21*c* is placed on the upper head 21*a* and the upper head is fitted on the outer periphery of the syrup nozzle head 19 from below, the lower head 21*b* is threaded onto the outer periphery of the syrup nozzle head 19 from below to hold the upper head 21*a* between a flange portion 19*c* extending from the upper end of the syrup nozzle head 19 to the outer periphery of the head and the lower head 21*b*.

The head cover 21*c* has pipe joints 26, 27 provided at locations opposed to the peripheral groove 21*a*-1 of the upper head 21*a* for allowing a cold-water line and a carbonated-water line to be connected thereto in order to introduce cold and carbonated water. The pipe joints 26, 27 are fitted in the upper head 21*a* via O-rings 24 in a liquid-tight manner.

In addition, the spout nozzle 22 has a horizontal staged portion 22*a* at a location against which a syrup is ejected from the corresponding syrup nozzles 19*b* of the syrup nozzle head 19. Thus, a syrup ejected from one of the syrup nozzles 19*b* and a diluent flowing down along the inner wall surface of the spout nozzle can be sufficiently mixed together at this staged portion 22*a* before the mixture flows out downward through a drink ejection port 22*b* at the tip of the nozzle.

To assemble the drink supply nozzle 2 of the above structure, the assembly of the upper head 21*a* and head cover 21*c* of the diluent nozzle head 21 is inserted into the outer periphery of the syrup nozzle head 19 from below, and the lower head 21*b* is threaded onto the syrup nozzle head 19 and fixed in position. Furthermore, the syrup nozzle cover 20 is threaded onto the syrup nozzle head 19 and coupled thereto, then the spout nozzle 22 is placed on the outer periphery of the upper head 21*a*, and finally the assembly base 23 is inserted into the outer periphery of the spout nozzle 22 from below. Arm portions extending in a lateral direction from the upper head 21*a* and head cover 21*c* of the diluent nozzle head 21 are then coupled by using bolts 25 to support arms 23*a* extending upward from the assembly base 23, in order to fix each part in its assembly position.

In addition, during assembly, the passage gap in the conical diluent pressure-reducing passage 21*d* formed in the fitting surfaces between the upper and lower heads 21*a* and 21*b* of the diluent nozzle head 21 can be varied by adjusting the amount of threading with which the lower head 21*b* is threaded onto the upper head 21*a*. Thus, the channel resistance can be adjusted so that the pressure of carbonated water fed from the carbonator can be reduced to an appropriate value.

Furthermore, in the illustrated example, check valves 28 are connected to the above cold-water inlet and carbonated-water inlet so as to prevent carbonated water from flowing backward into the cold-water line and cold water from flowing backward into the carbonated-water line due to drink remaining in the spout nozzle 22.

With the above construction, when a desired syrup-based carbonated drink is selected during a drink sale, the selected syrup and carbonated water are supplied to the drink supply nozzle 2. The syrup is then ejected from the tip of the syrup nozzle 19*b* toward the inner wall surface of the spout nozzle 22 through the corresponding syrup introduction passage 19*a* of the syrup nozzle head 19. On the other hand, the carbonated water introduced into the diluent nozzle head 21 is dispersed to a peripheral area of the diluent pressure-reducing passage 22*d* from the peripheral groove 21*a*-1 in the upper head 21*a* via diluent passage holes 21*a*-2. Further, the pressure of the carbonated water is reduced to an appropriate value while flowing down through the diluent pressure-reducing passage 22*d*, and is then ejected inward of the spout nozzle 22 from an outer peripheral terminal of the passage 22*d*. The carbonated water flows downward through the gap between the syrup nozzle head and the syrup nozzle cover 20, and is mixed with the syrup at the staged portion 22*a*. It then flows downward from the drink ejection port 22*b* so as to be supplied to the cup.

Figure 12:
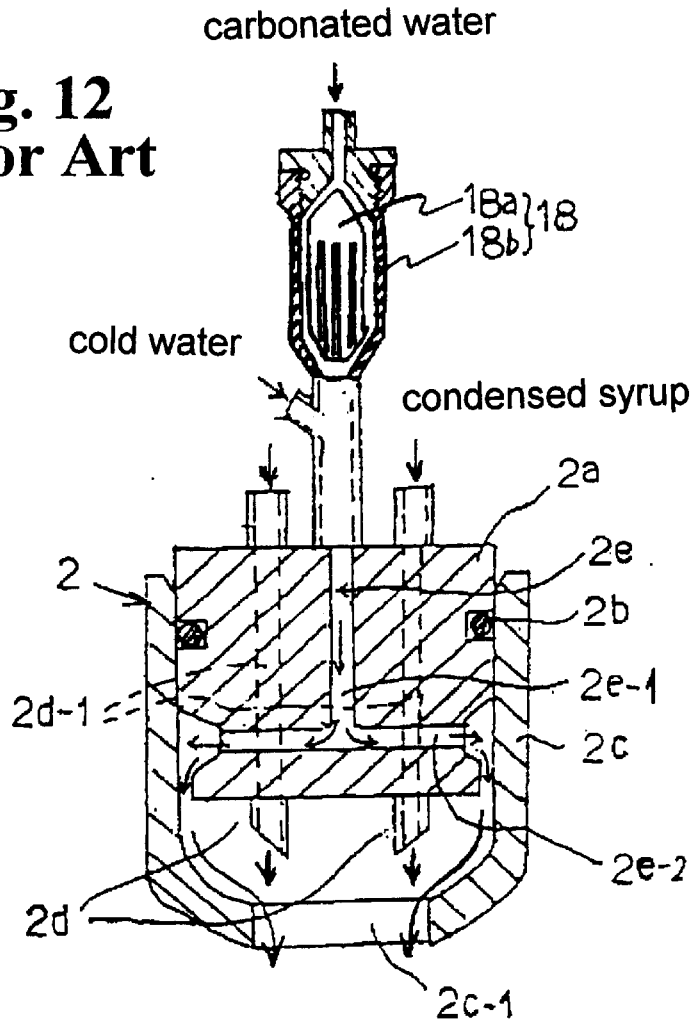
Fig. 12 Prior Art
FIG. 12 is a sectional view of a structure of a conventional syrup drink supply nozzle used in FIG. 11.
Figure 13:
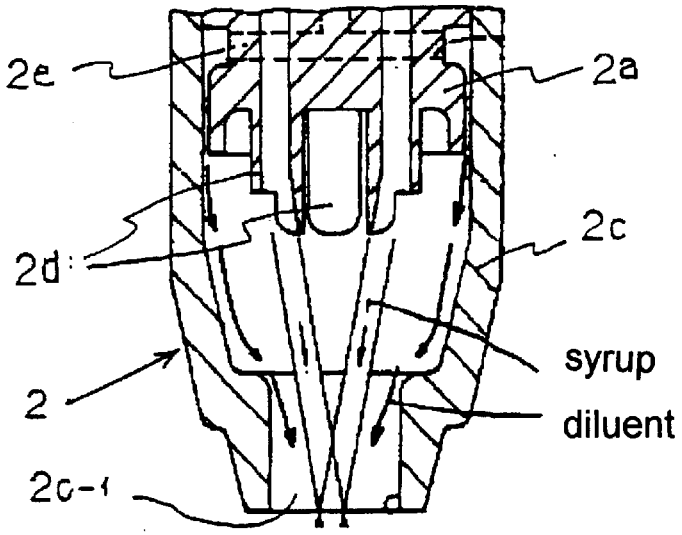
Fig. 13 Prior Art
FIG. 13 is a sectional view of a conventional example different from that shown in FIG. 12.

In this case, since the syrup nozzle head 19 has a tip formed into a spherical surface with the syrup nozzles 19*b* dispersed on a peripheral surface area thereof, virtually no syrup ejected from the selected syrup nozzle 19*b* splashes on and adheres to the other syrup nozzles 19*b*, and drink adhering to the head tip is dropped smoothly along the downward spherical surface, thereby preventing the syrup residue from adhering to the nozzle head. In addition, the diluent (carbonated water) pressure-reducing passage 21*d* is formed in the passage area immediately before the location at which the diluent is ejected inward of the spout nozzle 22, so that the ejection of the carbonated water occurs immediately after its pressure has been reduced to an appropriate value. This construction enables a cup to be supplied with a high-quality carbonated drink with a high gas content, as compared to the construction with the pressure-reducing valve 18 connected to the introduction side of the drink supply nozzle 2 as in the conventional example shown in FIG. 12. In addition, the spout nozzle 22 has the staged portion 22*a* at the location where the concentrated syrup is ejected from the corresponding syrup nozzle 19*b*, to thereby more effectively mix the syrup with the diluent.

On the other hand, to enable the syrup supply nozzle 2 to be washed during a maintenance work, the setting screws for the assembly base 23 are loosened and removed to allow the spout nozzle 22, the syrup nozzle cover 20, and the lower head 21*b*, upper head 21*a* and head cover 21*c* of the diluent nozzle head 21 to easily be removed manually from the syrup nozzle head 19 so that the individual parts can be washed. In addition, since the spherical-surface-shaped head tip is exposed by removing from the syrup nozzle head 19 the syrup nozzle cover 20 surrounding the periphery of the syrup nozzles 19*b,* the syrup nozzles 19*b* dispersed on a peripheral area of the head tip can be washed easily thoroughly. In addition, after washing, the parts can be simply reassembled by performing the disassembly procedure in reverse order. Further, even if the narrow diluent pressure-reducing passage 22*d* formed inside the diluent nozzle head 21 is blocked with a foreign material from a water service pipe, the foreign material in the passage can easily be removed by pulling the lower head 21*b* out from the upper head 21*a.*

Next, modified examples of the parts based on the above construction will be described.

Figure 5A:
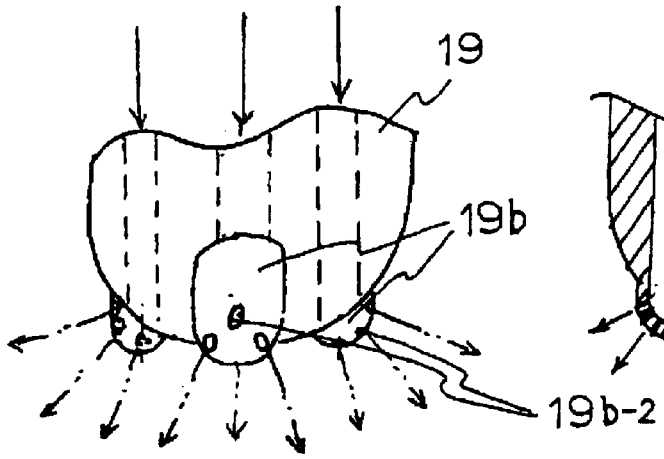
FIG. 5(*a*) is a side view for showing a tip portion of the syrup nozzle head of an example different from that shown in FIG. 4(*a*) and FIG. 5(*b*) is a sectional view thereof.
Figure 5B:
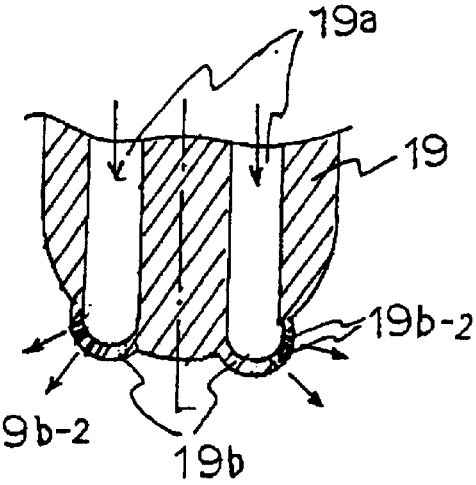

First, FIGS. 3–5(*b*) show modified examples for the syrup nozzles 19*b.* In FIG. 3, the syrup nozzle head 19 has its tip inclined outwardly toward the spout nozzle 22, so that a syrup ejected from the corresponding syrup nozzle 19*b* in the direction indicated by arrows collides with a diluent flowing down along the wall surface of the spout nozzle 22, resulting in mixture. In addition, in FIGS. 4(*a*)–5(*b*), each of the syrup nozzles 19*b* has a spherical tip, and in FIG. 4(*a*), each of the syrup nozzles 19*b* has a slit-shaped syrup ejection port 19*b*-1 formed in its outer peripheral surface like a single line extending in the horizontal direction of the nozzle, whereby the syrup is ejected toward the spout nozzle 22 while expanding in a fan shape, as indicated by arrows. In FIGS. 5(*a*) and 5(*b*), the nozzle 19*b* has multiple syrup ejection holes 19*b*-2 formed and scattered toward the inner wall surface of the spout nozzle 22, so that a syrup is ejected in the form of a shower, thereby effectively mixing a syrup ejected from the syrup nozzle 19*b* with a diluent flowing down along the spout nozzle 22.

Figure 6:
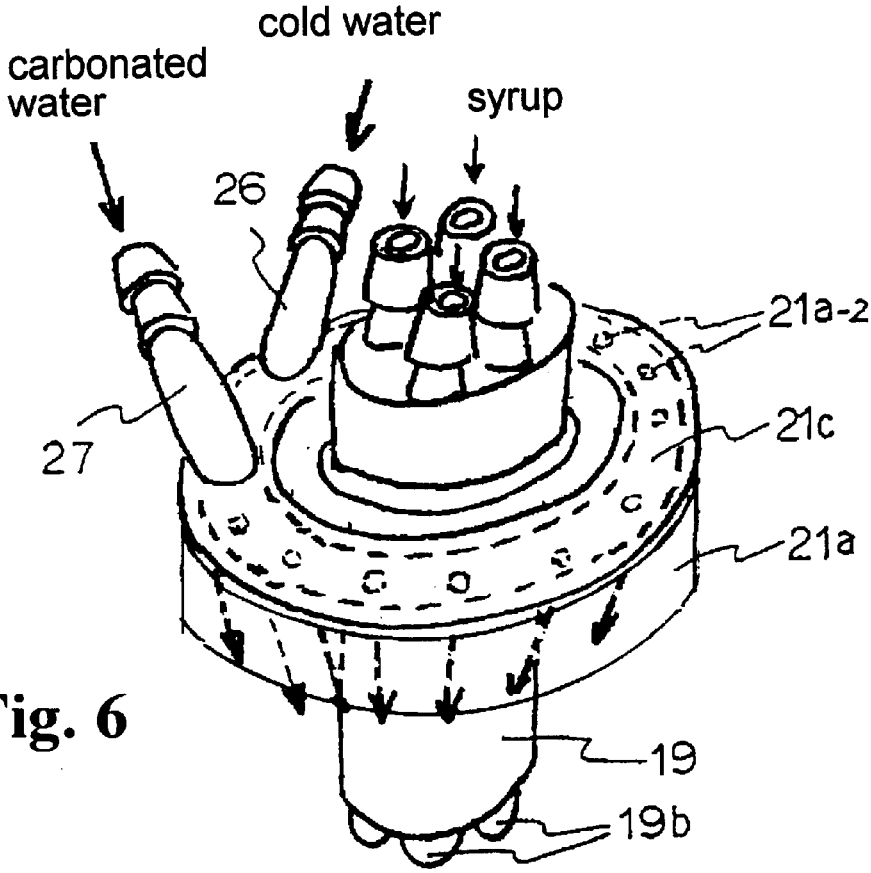
FIG. 6 is a perspective view for showing an assembly of an upper head of a diluent nozzle head and a syrup nozzle head.
Figure 7:
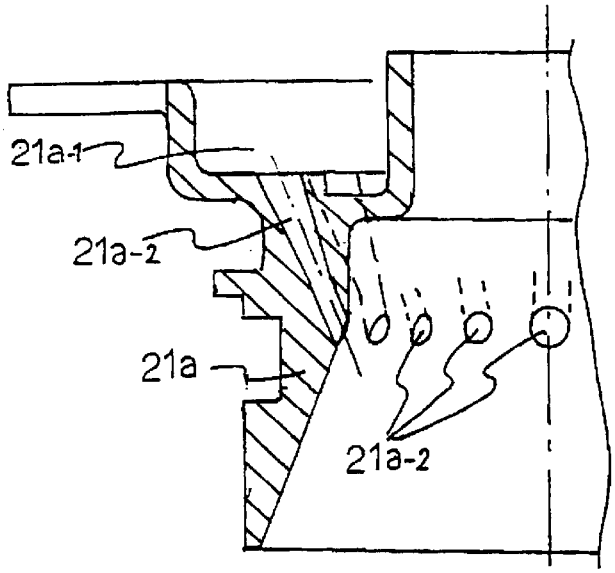
FIG. 7 is a sectional view of essential parts of a modified example of the upper head shown in FIG. 6.

In addition, FIG. 6 shows the upper head 21*a* of the diluent nozzle head 21 installed on the outer periphery of the syrup nozzle head 19. In the example shown in FIG. 7, each of the diluent passage holes 21*a*-2 formed along the peripheral groove 21*a*-1 in the upper head 21*a* is a tapered hole with a cross section gradually decreasing from its inlet to its outlet so that the holes 21*a*-2 have the same diameter at their outlet end area. Thus, a diluent (carbonated water) introduced into the gutter-shaped peripheral groove 21*a*-1 can be guided smoothly to the subsequent diluent pressure-reducing passage 21*d* (see FIG. 1(*a*)) through the diluent passage holes 21*a*-2, without rapid change in pressure of the introduced diluent (carbonated water).

Figure 8:
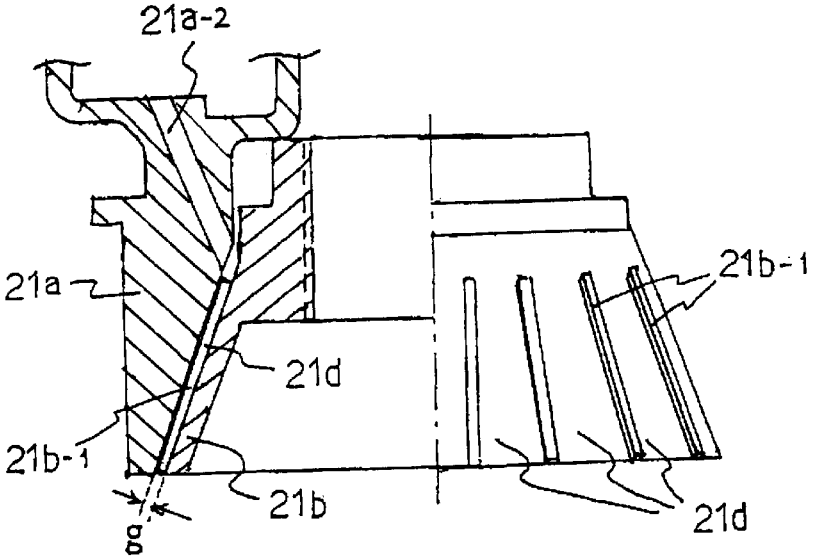
FIG. 8 is a partial sectional side view of a modified example of the diluent nozzle head shown in FIG. 1(*a*)

Next, FIG. 8 shows a modified example for the lower head 21*b* of the diluent nozzle head 21. In this example, the lower head 21*b* has a plurality of radially extending rib-shaped projections 21*b*-1 formed along its outer peripheral conical surface. The rib-shaped projections 21*b*-1 operate as both spacers for forming the diluent pressure-reducing passage 21*d* in the fitting surfaces between the upper head 21*a* and the lower head 21*b* when they are fitted together, and as straightening vanes for evenly dispersing the flow of a diluent. The rib height is set to correspond to a passage gap (g) so as to provide the channel resistance required to reduce the pressure of the carbonated water to an appropriate value in the diluent pressure-reducing passage 21*d,* and the distance between the centers of the rib-shaped projections 21*b*-l arranged on the conical surface is the same as the distance between the centers of the diluent passage holes 21*a*-2 formed in the upper head 21*a.* The rib-shaped projections 21*b*-1 are formed downstream of the open ends of the diluent passage holes 21*a*-2 so that the rib-shaped projections 21*b*-l will not occlude the outlets of the diluent passage holes 21*a*-2 when fitted on the upper head 21*a.*

Figure 9:
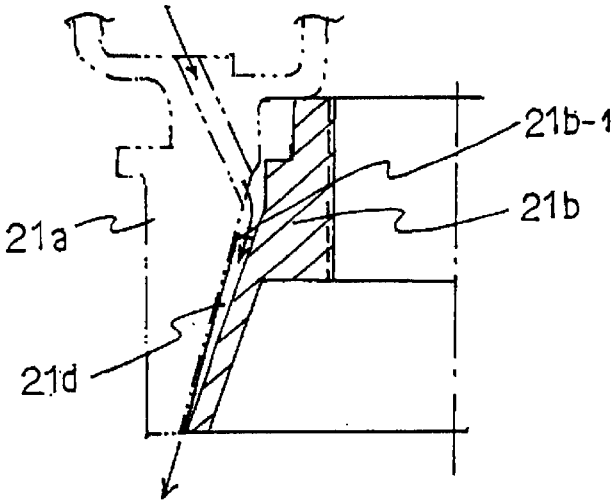
FIG. 9 is a sectional view of essential parts of an embodiment different from that shown in FIG. 8.

In addition, FIG. 9 shows an example obtained by improving the above structure. That is, if each of the rib-shaped projections 21*b*-1 is of the same height over its entire length as shown in FIG. 8, the cross section along the channel or path of the diluent pressure-reducing passage 21*d* with a conical surface necessarily increases from the inlet to the outlet of the passage. On the other hand, it is advantageous to minimize rapid change in the cross section of the diluent passage in order to maintain a high gas content while restraining the separation of gas from carbonated water as described above. Thus, according to this example, the height of the rib-shaped projections 21*b*-1 formed on the outer peripheral conical surface of the lower head 21*b* decreases toward the outlet of the diluent pressure-reducing passage 21*d.* Correspondingly, the size of the gap in the diluent pressure-reducing passage 21*d* formed between the upper head 21*a* and the lower head 21*b* gradually decreases toward the outlet of the passage, resulting in a generally constant passage in the cross section along the channel.

Figure 10A:
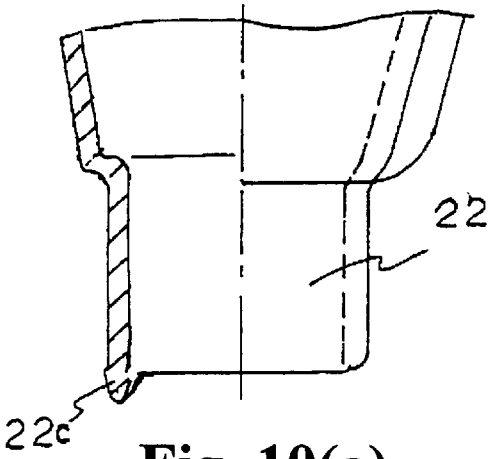
FIGS. 10(*a*) and 10(*b*) are partial sectional side views of spout nozzle tip portions for showing different examples of the spout nozzle shown in FIG. 1(*a*)
Figure 10B:
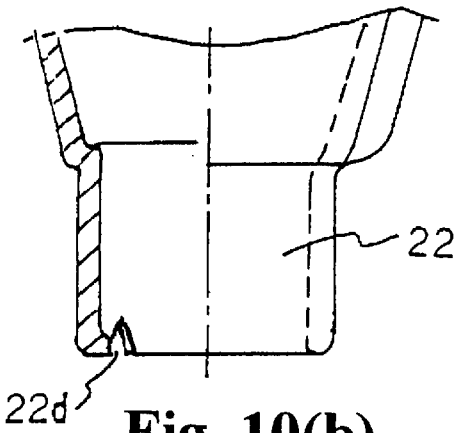
Figure 11:
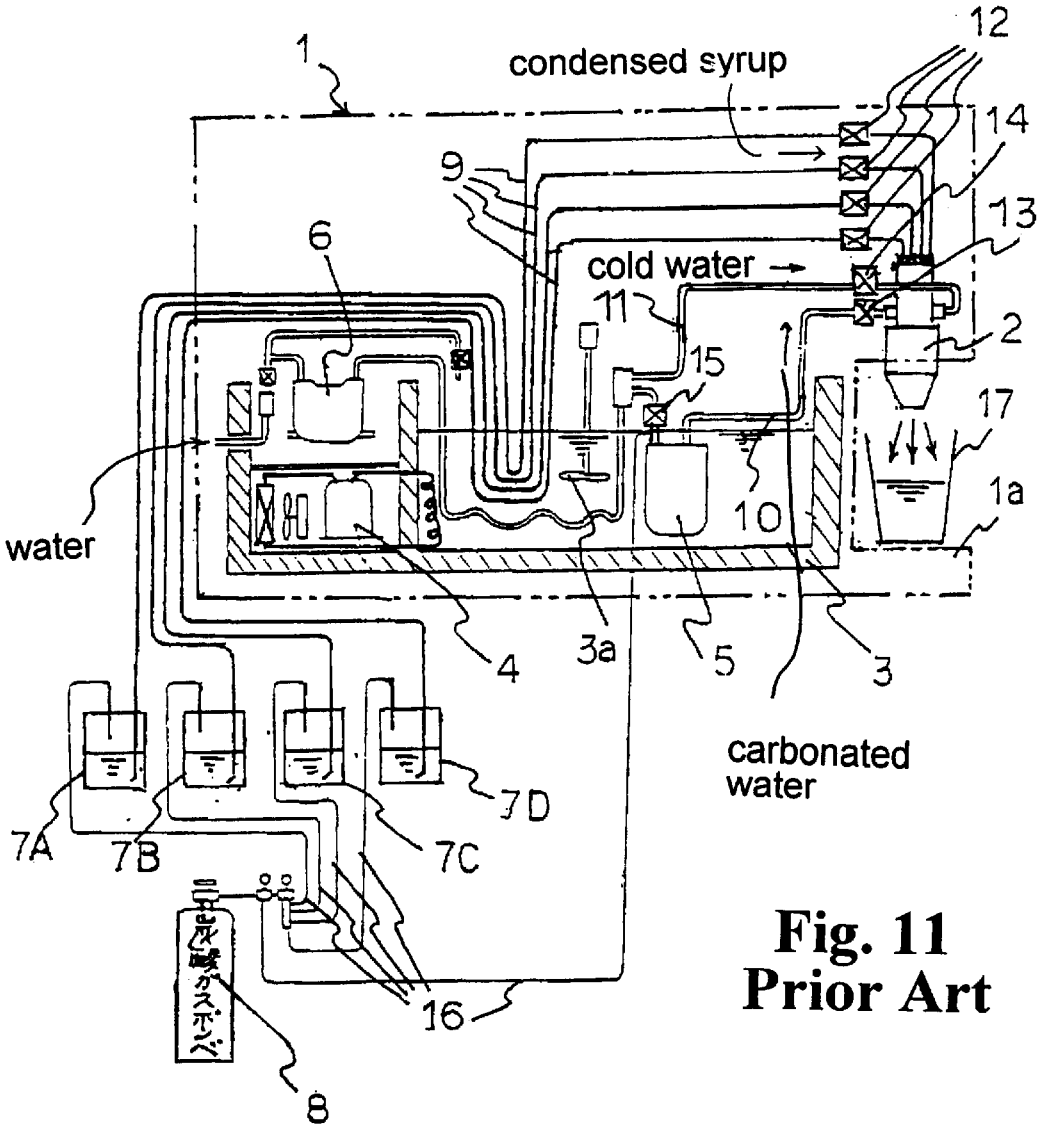
Fig. 11 Prior Art
FIG. 11 shows a drink system of a drink dispenser to which the syrup drink supply nozzle assembly is applied.

Next, FIGS. 10(*a*) and 10(*b*) show modified examples for the shapes of the drink ejection port 22*b* formed in the tip of the spout nozzle 22 shown in FIG. 1(*a*). When the drink ejection port 22*b* of the spout nozzle 22 has a small opening and a flat and continuous opening peripheral edge as shown in FIG. 1(*a*), the surface tension of the liquid may contribute to occluding the drink ejection port 22*b* to cause drink to remain inside the spout nozzle 22 after solenoid valves for the syrup and diluent lines have been closed during a drink supply operation. Thus, in the illustrated example, the drink ejection port 22*b* formed in the tip of the spout nozzle 22 has a water-deflector projection 22*c* (see FIG. 10(*a*)) or V-shaped water-deflector notches 22*d* (see FIG. 10(*b*)) formed in a portion of its peripheral edge so as to prevent surface tension, thereby effectively preventing a drink from remaining in the spout nozzle as described above.

As described above, according to the structure of the present invention, there is provided a syrup drink supply nozzle assembly that is highly practical and enables the parts to be assembled and disassembled easily in order to improve maintenance ability in terms of cleaning and foreign material removal, and that has functions enabling it to efficiently mix a syrup with a diluent and to supply a high-quality syrup drink without reducing the gas volume in the carbonated water.

While the invention has been explained with reference to the specific embodiments of the invention, the explanation is illustrative and the invention is limited only by the appended claims.

What is claimed is:

1. A syrup drink supply nozzle assembly for a drink dispenser, comprising:

a syrup nozzle head having a plurality of syrup introduction passages formed therein to introduce various syrups and syrup nozzles attached to the syrup introduction passages, a cylindrical syrup nozzle cover removably attached to a lower portion of the syrup nozzle head to surround the same, a diluent nozzle head removably attached onto an outer periphery of the syrup nozzle head and having a diluent passage for introducing cold diluent water or carbonated water, and a cylindrical spout nozzle removably installed to surround the syrup nozzle cover and the diluent nozzle head and having a drink ejection port at a tip thereof.

2. A syrup drink supply nozzle assembly according to claim 1, wherein said syrup nozzle head has a spherical lower surface, said syrup nozzles being arranged to be dispersed at the spherical lower surface to project outwardly therefrom, each syrup nozzle having a tip opened toward an inner surface of the spout nozzle.

3. A syrup drink supply nozzle assembly according to claim 1, wherein said syrup nozzle has a pipe-shape with an open end cut obliquely to face an inner surface of the spout nozzle.

4. A syrup drink supply nozzle assembly according to claim 1, wherein said syrup nozzle has a pipe-shape with an open end inclined toward an inner surface of the spout nozzle.

5. A syrup drink supply nozzle assembly according to claim 1, wherein said syrup nozzle has a slit-shaped syrup ejection port opened in a horizontal direction toward an inner surface of the spout nozzle.

6. A syrup drink supply nozzle assembly according to claim 1, wherein said syrup nozzle has a plurality of syrup ejection holes dispersed and opened toward an inner surface of the spout nozzle.

7. A syrup drink supply nozzle assembly according to claim 1, wherein said syrup nozzle cover has a threaded to removably couple to the syrup nozzle head.

8. A syrup drink supply nozzle assembly according to claim 1, wherein said diluent nozzle head includes an upper head with a conical inner surface, having a peripheral groove constituting a diluent introduction passage and a plurality of diluent passage holes dispersed along the peripheral groove to communicate therewith; and a lower head having a conical outer surface, said upper and lower heads being fitted together in a vertical direction to form a diluent pressure-reducing passage formed between the inner and outer surfaces to communicate with the peripheral groove.

9. A syrup drink supply nozzle assembly according to claim 8, wherein said lower head has a thread engaging an outer peripheral surface of the syrup nozzle head, a gap of the diluent pressure-reducing passage formed between the upper and lower heads being adjusted by an amount of movement of the lower head relative to the upper head.

10. A syrup drink supply nozzle assembly according to claim 8, wherein said diluent passage holes formed in the upper head are tapered such that an area of the hole gradually decreases from an inlet to an outlet.

11. A syrup drink supply nozzle assembly according to claim 8, wherein said lower head has rib-shaped projections formed on the outer peripheral surface so as to radially extend along a conical surface, said rib-shaped projections forming paths of the diluent pressure-reducing passage and operating as spacers between the upper and lower heads.

12. A syrup drink supply nozzle assembly according to claim 11, wherein said rib-shaped projections are formed at a side close to the drink ejection port relative to the diluent passage holes in the upper head.

13. A syrup drink supply nozzle assembly according to claim 11, wherein said diluent pressure-reducing passage formed between the upper and lower surfaces of the upper head and the lower head with the rib-shaped projections has a gap gradually decreasing toward an outlet side of the passage, a cross sectional area of the path of the diluent pressure-reducing passage perpendicular to a longitudinal direction of the diluent pressure-reducing passage being substantially constant.

14. A syrup drink supply nozzle assembly according to claim 1, wherein said spout nozzle has a flat staged portion, to which a syrup is ejected from the syrup nozzle.

15. A syrup drink supply nozzle assembly according to claim 1, wherein said spout nozzle has a water-deflector projection on a peripheral edge of the drink ejection port of the spout nozzle.

16. A syrup drink supply nozzle assembly according to claim 1, wherein said spout nozzle has dewatering notches in a peripheral edge of the drink ejection port of the spout nozzle.

17. A syrup drink supply nozzle assembly according to claim 1, further comprising a cold-water introduction port and a carbonated-water introduction port connected to the diluent nozzle head, and check valves attached to the cold-water introduction port and the carbonated-water introduction port.

* * * * *